United States Patent [19]

White

[11] Patent Number: 4,510,688

[45] Date of Patent: Apr. 16, 1985

[54] SEAM RIPPER

[76] Inventor: Leola E. White, 6811 SW. Florence La., Portland, Oreg. 97223

[21] Appl. No.: 511,764

[22] Filed: Jul. 8, 1983

[51] Int. Cl.[3] ..... B26B 27/00

[52] U.S. Cl. ..... 30/294; 30/DIG. 8

[58] Field of Search ..... 30/286, 293, 294, 295, 30/DIG. 8, 30, 31

[56] References Cited

U.S. PATENT DOCUMENTS

| | | | |
|---|---|---|---|
| 630,792 | 8/1899 | Applebay . | |
| 1,095,606 | 5/1914 | Trafford | 30/286 |
| 1,315,312 | 9/1919 | Klenck | 30/DIG. 8 |
| 1,454,055 | 5/1923 | Klamroth . | |
| 1,660,340 | 2/1928 | Kehetian . | |
| 1,976,290 | 10/1934 | Motley | 30/30 |
| 2,254,199 | 9/1941 | Baltuch | 30/289 |
| 2,576,618 | 11/1951 | Mansfield | 30/31 |
| 2,610,399 | 9/1952 | Adams | 30/294 |
| 2,688,187 | 9/1954 | Pauli | 30/289 |
| 2,710,448 | 6/1955 | Andrews | 30/DIG. 8 |
| 3,183,589 | 5/1965 | Szabo | 30/30 |

*Primary Examiner*—Jimmy C. Peters

*Attorney, Agent, or Firm*—Chernoff, Vilhauer, McClung, Birdwell & Stenzel

[57] ABSTRACT

A seam ripper comprising a holder and a blade has a guide portion in the holder with a notch for exposing a portion of the blade. The guide portion has upper and lower surface which form a wedge for separating the cloth from the seam so that only the stitching in the seam is engaged by the blade.

6 Claims, 8 Drawing Figures

FIG. 1
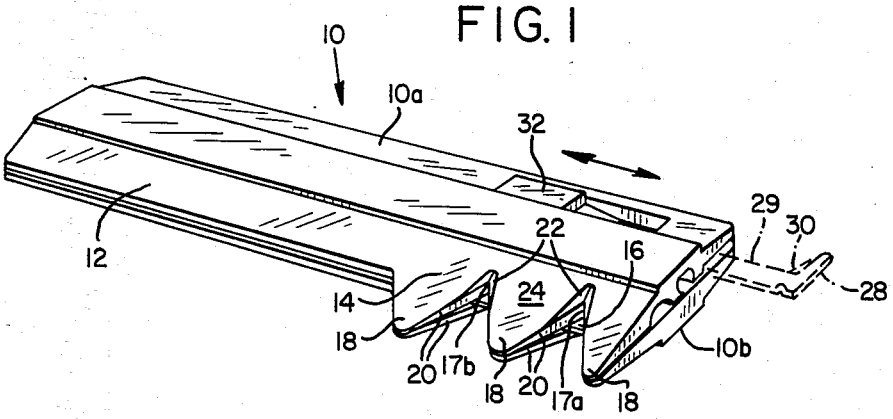
FIG. 2
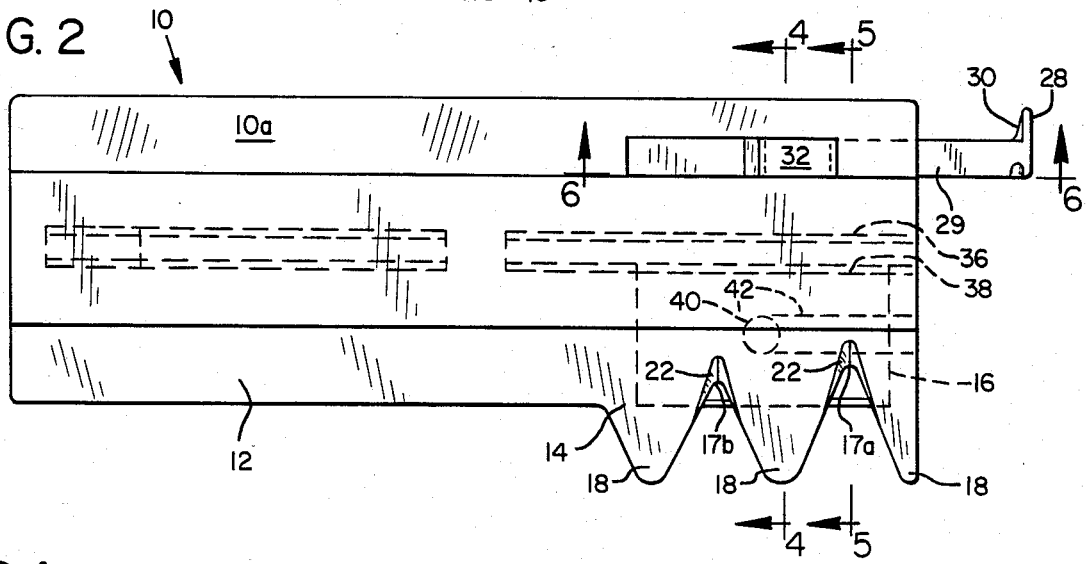
FIG. 4
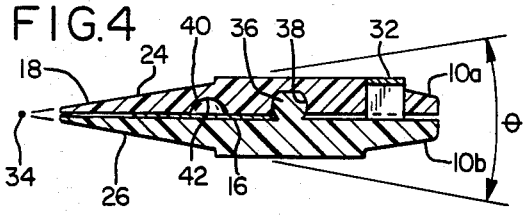
FIG. 5
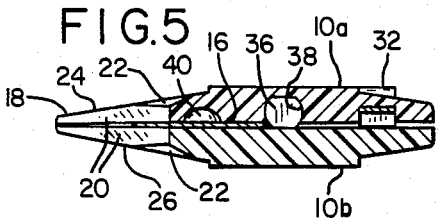
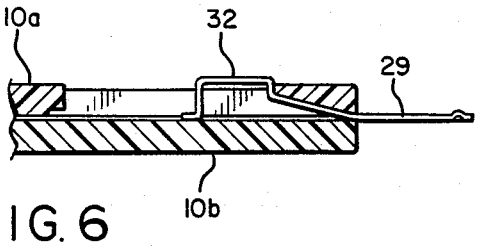
FIG. 6
FIG. 3
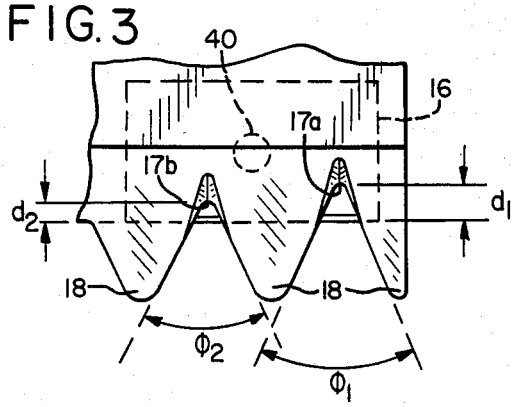

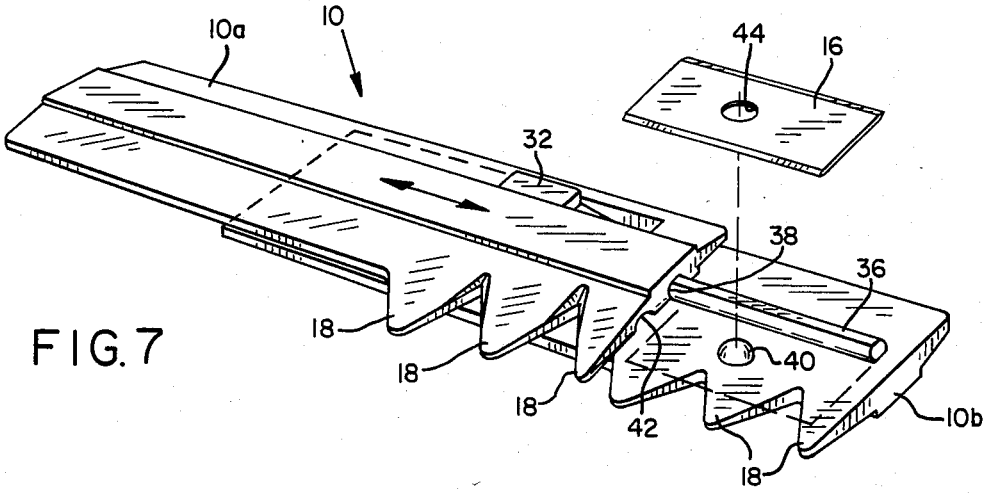
FIG. 7
FIG. 8
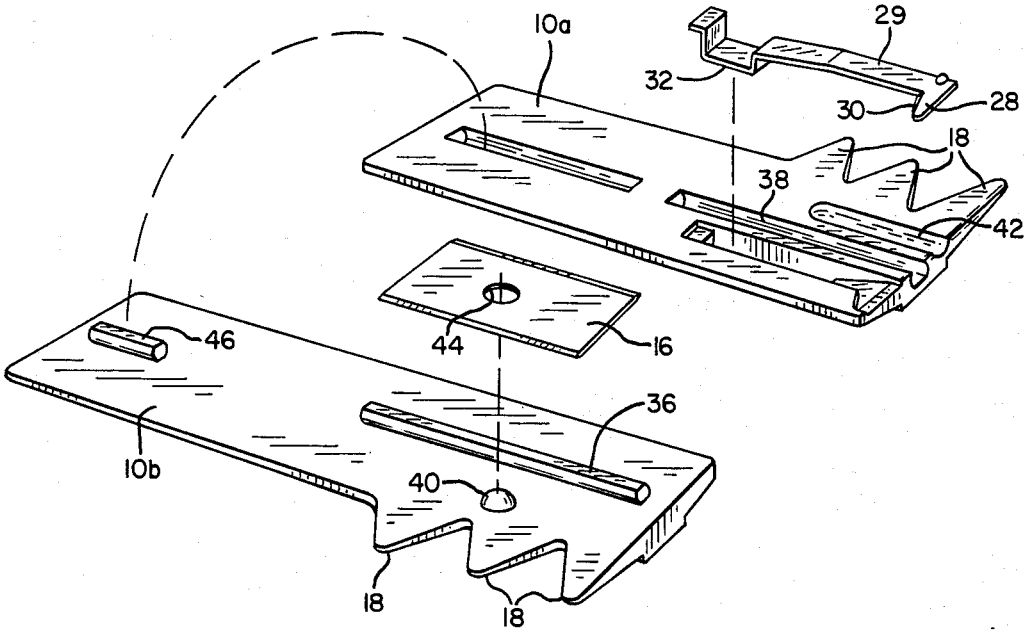

SEAM RIPPER

BACKGROUND OF THE INVENTION

The present invention relates to an apparatus for ripping seams and hems or for otherwise separating two pieces of cloth which have been sewn together.

Cutting tools for removing seams and hems are well known in the prior art; however, all such tools suffer from two major disadvantages: they are slow, and they tend to cut the material or cloth rather than the seam. For example, the Kehetian Patent, U.S. Pat. No. 1,660,340, shows a typical seam cutting device consisting of a two piece holder for grasping a razor blade or similar cutting edge, and a guide finger to hook into the seam or hem and bring the stitch into contact with the blade where it can be severed. Due to its cross-sectional geometry, however, the '340 device can only cut very slowly. In cross section, this device can be viewed as a series of flat plates, one of which is the blade edge, wherein the plates grasp the blade between them. With such an arrangement it is likely that the user will tear the cloth if an attempt is made to move the cutter rapidly along the seam. The problem is that the seam is presented with the essentially vertical walls of the plates which tend to bunch the material or fabric in towards the blade. This increases the risk that if the cutter is moved too swiftly, the material itself will be engaged by the blade and cut.

A similar device having essentially the same deficiency is shown in Baltuch U.S. Pat. No. 2,254,199. The device of the '199 patent is even less desirable for the cutting of seams and the like because of its inclined guide member and blade, which form an oblique angle to the seam and make it difficult to align the cutter for movement in a straight line.

This problem is alleviated to a degree in Pauli, U.S. Pat. No. 2,688,187, which shows a holder utilizing a razor blade as a cutting tool and a V-shaped notch in one side of the holder for ripping seams. The Pauli device, however, suffers from the problems previously encountered with the seam cutters in both the '340 and '199 patents, in that the cross-sectional shape of the cutter is essentially rectangular which does not serve to efficiently separate the cloth from the stitch prior to engagement by the blade. In addition, in the '187 device, the blade occupies most of the transverse dimension exposed by the notch. Having the blade lie so far forwardly of the vertex of the notch will also cause the blade to sever the material as well as the stitch.

The blade is recessed much further into the notch in Applebay U.S. Pat. No. 630,792. Deeply recessing the blade also presents a problem where simple forward pressure of the handle is the sole means used for cutting the stitch. Ordinarily, recessing the blade far into the notch will result in the need for greater forward pressure in order to sever the stitch. To compensate, Applebay uses reciprocating motion of the blade to cut the stitch, which is awkward and slow. The Applebay device also utilizes a handle which is perpendicular to the edge of the blade. It is much more difficult to cut a stitch in this manner since the handle must be aligned longitudinally with the stitch.

Another approach is shown in Klamroth U.S. Pat. No. 1,454,055. In the '055 device the blade edge is exposed without any type of guide or notch. This arrangement will almost certainly lead to a cutting of the material if attempted to be used with a ripping motion. One embodiment of Klamroth shows a guide having a round cross section. This guide, however, extends too far above and below the blade and thus renders it unsuitable for use as a seam ripper since it would be hard to force the blade to make contact with the stitching. Additionally, the guide is essentially hollow and fails to provide any means for separating the cloth from the stitch as the seam moves into the guide channel. Cloth and stitching would tend to bunch up in the channel resulting in severing of the cloth.

Thus, while all of the aforementioned references provide a cutter having a channel to guide a seam onto a blade, all suffer from one or more deficiencies which render the cutter either too slow or subject the fabric itself to the danger of being cut because the cloth sewn together at the seam is not sufficiently separated from the seam prior to engagement by the blade. None of the aforementioned references are capable of guiding the seam onto the edge of the blade while at the same time keeping the fabric away from the blade, such that the cutter may be rapidly moved along the seam with a smooth ripping motion.

SUMMARY OF THE INVENTION

These and other deficiencies are remedied by the present invention in which the cutting tool has a handle or holder having a forward edge which extends parallel to the cutting edge of the blade so that the cutting tool may be grasped from the side. The holder has a guide portion having upper and lower planar surfaces which are inclined obliquely with respect to the plane of the blade. These surfaces converge toward a line which lies transversely forwardly of the edge of the blade thereby forming a cross-sectional wedge.

It has been found that seam rippers of the types heretofore known were incapable of efficiently and swiftly ripping seams with a smooth motion because no means were provided to guide the fabric away from the cutting edge of the blade, while at the same time exposing only the stitching to the blade. In order to overcome this difficulty, in the subject invention the surfaces of the guide portion, both above and below the blade, are inclined at an oblique angle relative to the blade so that in cross section the tool is wedge-shaped. This wedge serves to gradually separate the cloth from the seam so that only the seam is guided onto the cutting edge of the blade. By providing a gradual separation, as opposed to an abrupt separation as is the case with guides having forward walls which are essentially perpendicular to the top and bottom parallel surfaces, the tool may be guided along the seam rapidly and with a smooth ripping motion without tearing the material.

The holder has at least one opening of a predetermined dimension exposing a portion of the cutting edge of the blade. In the preferred embodiment the opening is a V-shaped notch although other configurations could be used. Adjacent to the vertex of the notch, the walls of the guide portion are bevelled. The inclined surfaces of the guide and the interior bevelling of the walls of the guide serve to separate the fabric from the stitching such that only the stitches are exposed to the cutting edge of the blade. The fabric is guided away from the blade, such that a long seam may be cut in its entirety with one smooth ripping motion, obviating the need to cut each stitch individually, and eliminating the risk that the fabric sewn together at the seam will be cut if excessive force or speed is attempted to be used.

Providing the tool with a cross-sectional wedged shape results in significant improvement in the performance of this type of cutting tool over that previously used. It has also been determined that certain other parameters of such tools may be optimized for superior performance. For example, it has been found that the angle encompassed by the intersection of the upper and lower planar surfaces, i.e. the wedge, should lie within a range of between 10 and 30 degrees. Also leading to a significant improvement in performance, is the providing of a V-shaped notch or guide channel wherein the angle of the "V" lies within a range of between 45 and 65 degrees. With a larger angle, the guiding function of the notch is ineffective; with a narrower angle, the material tends to become bunched up in a vertex of the notch and either impedes the forward progress of the tool or subjects the cloth to being cut. It has also been determined that the optimum blade exposure, that is, the dimension from the tip of the blade to the vertex of the notch, should be between $\frac{1}{4}$ and $\frac{1}{8}$ of an inch. If it is more than $\frac{1}{4}$ inch, too much of the blade is exposed and there exists a possibility of cutting the fabric. If less than $\frac{1}{8}$ inch of the blade is exposed, the blade will not reach the seam. The choices for combinations of these parameters depend upon the type of stitch to be cut. Generally, wider stitches require a wider angle and shallower blade depth, whereas narrow stitches require a narrow angle, but more blade exposure.

The holder comprises a two piece construction slidably connected by a tongue and groove arrangement and having a stop for halting the slidable movement upon exposure of the blade. The blade is mounted on a post with one edge abutting the tongue of the lower half which holds it parallel to the edge of the handle.

Provision is also made for a slidably mounted cutting finger, which can be used to initially separate a sufficient number of stitches to insert the guide portion of the tool and engage the seam.

It is therefore an object of this invention to provide a seam ripper capable of rapidly ripping a seam without injuring the cloth sewn together at the seam;

It is another object of this invention to provide a cutting tool for separating two pieces of cloth sewn together with stitching such that only the stitching is exposed to the blade of the cutting tool;

A still further object of this invention is to provide a seam ripper whereby the user's hand may move parallel to the seam but to the side thereof with a swift and efficient motion, without damaging the cloth sewn together at the seam.

These and other objects of the invention will become apparent by reference to the drawings and the detailed description of the invention with follows.

BRIEF DESCRIPTION OF THE DRAWINGS

FIG. 1 is a perspective view of the seam ripper which is the subject of the invention;

FIG. 2 is a plan view of the seam ripper shown in FIG. 1;

FIG. 3 is a fragmentary plan view of a portion of the seam ripper shown in FIG. 2 illustrating selected dimensional parameters of the invention;

FIG. 4 is a side elevational view of the seam ripper taken along line 4—4 in FIG. 2;

FIG. 5 is a side elevational view of the seam ripper taken along line 5—5 in FIG. 2;

FIG. 6 is a partial side view taken along line 6—6 of FIG. 2;

FIG. 7 is a perspective view of the seam ripper illustrating the way in which the blade is mounted and installed;

FIG. 8 is an exploded perspective view of the seam ripper showing the top portion of the tool in an inverted position and illustrating the manner in which it is constructed.

DETAILED DESCRIPTION OF THE INVENTION

Referring now to FIG. 1, a seam ripper comprising a holder 10 and a blade 16 has an elongate handle portion 12, and a guide portion 14. The guide portion 14, has a series of teeth 18 formed in it, which form V-shaped notches 17*a* and 17*b*. Within the guide portion is held a blade 16, with the exposed portion of the blade lying within the V-shaped notches 17*a* and 17*b*. The notches have inner walls 20, which are bevelled, adjacent to the vertices of the notches as shown at 22. The guide portion has an upper surface 24 and a lower surface 26 (refer to FIG. 3 and FIG. 4) which are planar and which form oblique angles to the plane of the blade 16. The seam ripper of FIG. 1 also has a rearwardly protruding finger 28, with an obliquely inclined blade 30. The finger and blade combination is mounted on a shank 29 which is slideably attached to the handle and which is moveable by the use of a thumb pad 32. The holder 10 comprises upper and lower sections 10*a* and 10*b*, which are slidable relative to each other as will be hereinafter explained.

Referring now to FIG. 4, it can be seen that the upper and lower surfaces, 24 and 26 respectively, of the guide portion are planar surfaces whose planes intersect at a line indicated at 34, which is disposed forwardly of and parallel to the cutting edge of the blade 16. As indicated by the dashed lines in FIG. 4, the planes are oblique to the plane of blade 16, and form an enclosed angle $\theta$. For optimum performance it has been found that the angle $\theta$ should have a value between 10 degrees and 30 degrees. Thus, when the guide portion 14 engages a hem or seam, and the tool is moved forwardly, surfaces 24 and 26, which form a cross-sectional wedge sandwiching the blade therebetween, gradually lift and guide the fabric away from the blade, while at the same time exposing the threads of the seam to the cutting edge of the blade. The wedge geometry thus permits the tool to cut the seam with a single rapid ripping motion. The speed and smoothness of this motion is aided by the bevelled surfaces 22 which lie adjacent the vertex of notches 17*a* and 17*b*, at the juncture of inner walls 20 and upper planar surface 24, as shown in FIG. 5. Lower surface 26 is similarly bevelled at its junctures with inner walls 20.

FIGS. 4 and 5 also illustrate the way in which the two halves of the seam ripper 10 are connected to one another, with one half being slidable with respect to the other. The lower half of the seam ripper has a tongue 36, which is adapted to slidably engage a groove 38 located in the upper half 10*a*. As shown best in FIG. 8, a post 40 located in the lower half 10*b* is slidable within a hollow channel 42 located in upper half 10*a*. However, the channel 42 is open ended so that the post becomes exposed when the pieces 10*a* and 10*b* are moved transversely with respect to one another as shown in FIG. 7. As shown in FIG. 7 and FIG. 8 the blade, which has a central aperture 44, is inserted over post 40, and the two halves slide together to sandwich the blade therebetween. In order to alleviate the possibility that the upper and lower halves, 10*a* and 10*b*, could become completely separated through such sliding motion, and one of the pieces possibly lost, provision is made for insuring that the slidable disposition of the pieces need go no farther than enough distance to expose the blade 16. To that end, a second tongue 46 is provided which lies within a groove 48. The second tongue 46, in cooperation with the groove 48, serves as a stop which limits the slidable motion of upper half 10*a* with respect to lower half 10*b*.

In FIG. 3 are shown certain features of the invention which optimize its performance. In the preferred embodiment of the invention, there are three teeth 18, forming two notches 17*a* and 17*b*. The angle $\phi_2$ formed by the side walls of notch 17*b* is larger than the angle $\phi_1$ of notch 17*a*. The blade depth of notch 17*a*, however, indicated as distance $d_1$, is greater than the corresponding blade depth $d_2$ of notch 17*b*. The reason for this is that notch 17*a* is intended to be used when ripping seams having a narrow stitch, that is, extending in a straight line along a hem or seam. Notch 17*b*, on the other hand, is intended to be used with wider stitches such as zigzag stitches, and consequently a wider angle is provided. However, with a wider angle comes the accompanying problem that the cloth sewn together by the stitch could be engaged by the blade and damaged. Accordingly, with such wider angle notches, the blade depth $d_2$ is shallower. It has been found that the optimum parameters for notches of both types require a notch angle of between 45 and 65 degrees, and a blade depth of between $\frac{1}{4}$ inch and $\frac{1}{8}$ inch. For example, notch 17*a*, which is designed for single stitch ripping, would have an angle $\phi_1$ of close to 45 degrees and a blade depth $d_1$ not greater than $\frac{1}{4}$ inch. On the other hand, a notch such as 17*b* would have an angle $\phi_2$ not to exceed 65 degrees and a blade depth $d_2$ slightly greater than $\frac{1}{8}$ inch. These parameters may be adjusted for the particular user's needs, but for optimum performance should not lie outside the values recommended herein.

The terms and expressions which have been employed in the foregoing specification are used therein as terms of description and not of limitation and there is no intention in the use of such terms and expressions of excluding the equivalents of the features shown and described or portions thereof. It being recognized that the scope of the invention is defined and limited only by the claims which follow.

What is claimed is:

1. A cutting tool comprising a holder and a blade, the forward edge of said holder having at least one V-shaped notch for exposing a portion of the cutting edge of said blade, said blade edge extending across said notch perpendicular to a line bisecting its vertex and deeply recessed within said notch, said holder having a guide portion with upper and lower substantially planar surfaces obliquely disposed with respect to the plane of said blade, wherein the planes of said surfaces converge in a line disposed transversely forwardly of the blade so that said surfaces form a wedge to separate materials sewn together by a seam prior to engagement of said seam by said blade when said tool is moved along said seam with said blade oriented substantially perpendicular thereto, wherein said V-shaped notch includes a pair of inner walls whose planes intersect with the planes of said upper and lower holder surfaces, further including a plurality of beveled surfaces extending along a portion of the juncture between said upper and lower surfaces and said inner walls adjacent the vertex of said notch.

2. The cutting tool of claim 1 wherein the angle formed by the intersection of the planes of said obliquely-disposed upper and lower planer surfaces lies in a range of between 10 and 30 degrees.

3. The cutting tool of claim 2 wherein the angle formed by the intersection of the inner walls of the V-shaped notch at the vertex of said notch lies in a range of between 45 and 65 degrees.

4. The cutting tool of claim 3 wherein the transverse distance between the edge of said blade and the vertex of said notch is between $\frac{1}{8}$ and $\frac{1}{4}$ inch.

5. The cutting tool of claim 4 wherein said holder includes at least two V-shaped notches wherein the angle of one of said notches is approximately 65 degrees and the transverse distance between the edge of the blade and the vertex of said notch is approximately $\frac{1}{8}$ inch, and a second notch wherein the angle of the notch is approximately 45 degrees and has a transverse distance between the edge of said blade and the vertex of said notch of approximately $\frac{1}{4}$ inch.

6. The cutting tool of claim 1 wherein said holder comprises upper and lower halves slidably disposed one with respect to the other, post means in one of said halves for detachably mounting said blade, said means slidably engaging a groove in the other of said halves correspondingly mating with said post, and stop means for preventing the slidable separation of said halves, said holder further including a tongue disposed adjacent said post and adapted to prevent the rotation of said blade when said blade is mounted on said post, and a groove in the other of said halves adapted to be engaged by said tongue to permit said slidable disposition while maintaining said halves substantially in contact with one another.

* * * * *

UNITED STATES PATENT AND TRADEMARK OFFICE

CERTIFICATE OF CORRECTION

PATENT NO. : 4,510,688

DATED : April 16, 1985

INVENTOR(S) : LEOLA E. WHITE

It is certified that error appears in the above-identified patent and that said Letters Patent is hereby corrected as shown below:

Abstract, line 4:
Change "surface" to --surfaces--

Column 5, line 45:
Change "thereof. It" to --thereof, it--

Column 6, line 19:
Change "planer" to --planar--

Signed and Sealed this

*Twenty-ninth* Day of *July 1986*

[SEAL]

*Attest:*

DONALD J. QUIGG

*Attesting Officer*

*Commissioner of Patents and Trademarks*